United States Patent [19]

Wohlrab

[11] 4,365,645

[45] Dec. 28, 1982

[54] THREE-WAY FLOW-REGULATING VALVE

[75] Inventor: Walter Wohlrab, Weissenburg, Fed. Rep. of Germany

[73] Assignee: Krauss-Maffei Aktiengesellschaft, Munich, Fed. Rep. of Germany

[21] Appl. No.: 293,990

[22] Filed: Aug. 18, 1981

[30] Foreign Application Priority Data

Sep. 12, 1980 [DE] Fed. Rep. of Germany ..... 3034377

[51] Int. Cl.[3] ..... G05D 11/00

[52] U.S. Cl. ..... 137/117

[58] Field of Search ..... 137/117, 116

[56] References Cited

U.S. PATENT DOCUMENTS

| | | | |
|---|---|---|---|
| 3,005,463 | 10/1961 | Van Meter | 137/117 |
| 3,128,783 | 4/1964 | Cowles et al. | 137/117 |
| 3,318,321 | 5/1967 | Odendahl | 137/117 |
| 3,965,921 | 6/1976 | Thurston | 137/117 |
| 4,114,637 | 9/1978 | Johnson | 137/116 |
| 4,285,198 | 8/1981 | Budecker | 137/117 |

FOREIGN PATENT DOCUMENTS 2151837 5/1972 Fed. Rep. of Germany .

*Primary Examiner*—H. Jay Spiegel
*Attorney, Agent, or Firm*—Karl F. Ross

[57] ABSTRACT

A three-way or three-ported flow-regulating valve for use in a hydraulic system comprises a two-position two-ported throttle valve inserted between an inflow conduit and an outflow conduit and a pressure-relief valve connected to the inflow conduit at an upstream point thereof and at a downstream point proximate to an intake port of the throttle valve. A servovalve is connected in parallel to the throttle valve via small-diameter pressure-transmission channels extending to the intake port and to an output port of the throttle valve. Upon a jump in the pressurization of the inflow conduit, for example due to the activation of an auxiliary pump, the pressure-relief valve opens; it closes again only upon an equalization of the pressure throughout the inflow conduit. The servovalve has a biasing spring which exerts a force determining the maximum pressure drop across the throttle valve.

1 Claim, 4 Drawing Figures

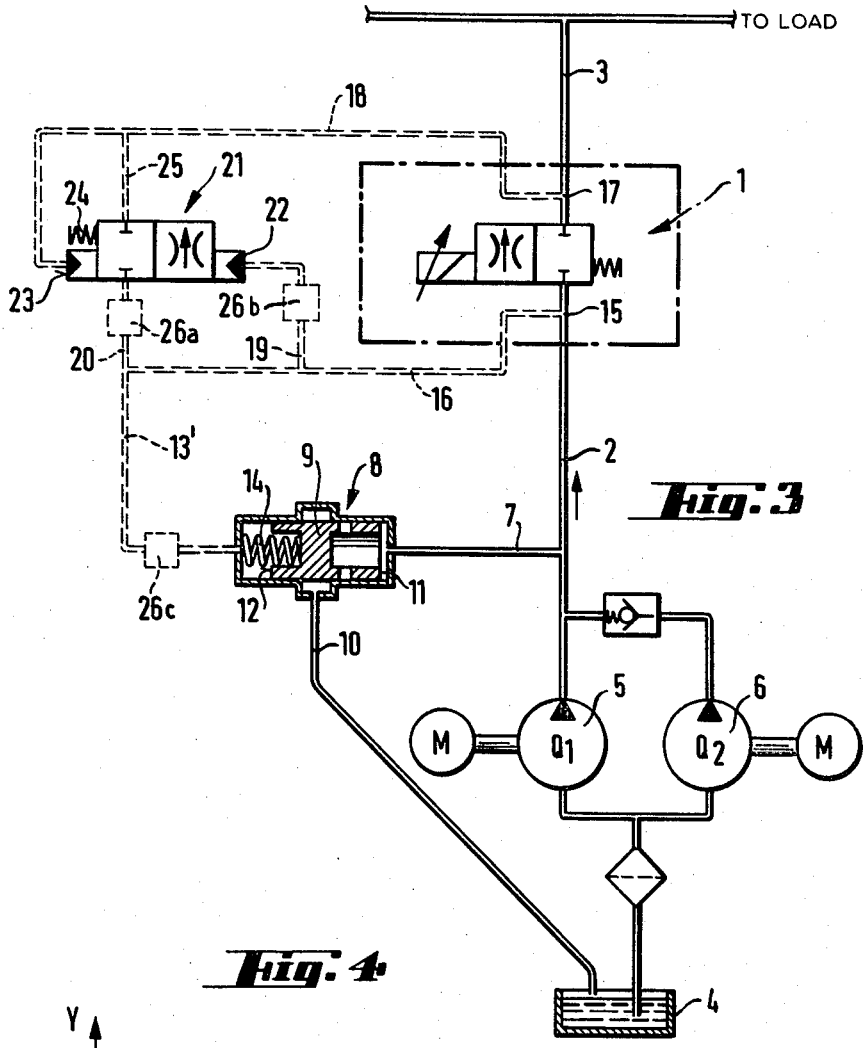
Fig. 3
Fig. 4
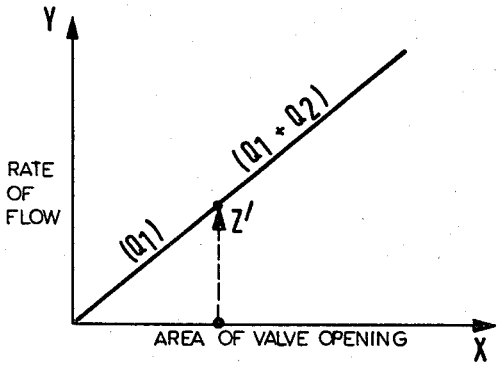

THREE-WAY FLOW-REGULATING VALVE

FIELD OF THE INVENTION

My present invention relates to a three-way flow-regulating valve.

BACKGROUND OF THE INVENTION

In a conventional three-way or three-ported flow-regulating valve an inflow channel is connected to an outflow channel via a throttle valve, a pressure-relief valve being connected in parallel thereto. The quantity of liquid moving through the outflow channel is determined by the pressure drop across the throttle valve, this drop being a function of the shutter opening in the throttle valve and of the pressure in the inflow channel. The force exerted by a biasing spring in the pressure-relief valve establishes an upper limit for the pressure drop across the throttle valve, the pressure-relief valve opening whenever the pressure difference between the inflow channel and the outflow channel exceeds this upper limit.

A disadvantage of conventional three-way flow-regulating valves is that a jump in the pressure of the fluid in the inflow channel, occasioned for example by the activation of an auxiliary pump, results in a sudden increase in the flow rate through the outflow channel. Such sudden flow-rate increases may have a deleterious effect on production and upon the life of hydraulic machinery.

OBJECT OF THE INVENTION

The object of my present invention is to provide a simple flow-regulating valve of the above-mentioned type in which the rate of flow through the outflow channel is controllable independently of sudden pressure changes in the inflow channel.

SUMMARY OF THE INVENTION

A three-way flow-regulating valve having a variable inflow rate comprises, according to my present invention, an inflow conduit, an outflow conduit and a throttle valve inserted between the two conduits, the valve being adjustable for varying the rate of fluid flow from the valve into the outflow conduit. One or more pumps are connected to the inflow conduit upstream of the throttle valve for pressurizing the inflow conduit, thereby driving fluid through the valve. A pressure-relief valve communicates directly with the inflow conduit at an upstream point thereof located between the pump and the throttle valve and at a downstream point located between the upstream point and the throttle valve. The pressure-relief valve is provided with a first valve piston having a first pressure surface acted upon by fluid from the upstream point of the inflow conduit and a second pressure surface acted upon by fluid from the downstream point, the pressure-relief valve further including a biasing spring engaging the second pressure surface. A fluid reservoir communicates with the pressure-relief valve for receiving overflow fluid therefrom upon a shifting of the piston by the pressure of the upstream point against a combination force exerted against the second pressure surface of the piston by the biasing spring and the pressure at the downstream point. A servovalve is connected to the outflow conduit and to the inflow conduit at an additional point located substantially downstream of the upstream point, the servovalve including a second valve piston having a third pressure surface acted upon by fluid from the additional point in the inflow conduit and a fourth pressure surface acted upon by fluid from the outflow conduit. The servovalve includes a biasing spring engaging the fourth pressure surface, the force exerted by this spring determining the maximum pressure drop across the throttle valve. The servovalve has an input port communicating with the inflow conduit and an output port communicating with a low-pressure fluid path. This path may extend from the outflow conduit to the fourth pressure surface of the servovalve piston or, alternatively, may empty into the reservoir.

According to another feature of my present invention, the downstream point and the additional point are identical and are located in the inflow conduit at an intake port of the throttle valve. The flow-regulating valve further comprises a pressure-transmission channel substantially smaller in cross-sectional area than the inflow conduit, this channel extending from the downstream (or additional) point to the second pressure surface of the pressure-relief valve, to the third pressure surface of the servovalve and the inport port thereof.

In conventional three-way flow-regulating valves the force exerted by the biasing spring of the pressure-relief valve against the second pressure surface thereof determines the maximum pressure drop across the throttle valve. In a flow-regulating valve according to my present invention the force exerted by the biasing spring of the pressure-relief valve against the second pressure surface of the first piston is immaterial to establishing the maximum pressure drop across the throttle valve. This force is sufficient to return the first valve piston to a valve-closed position only upon the attainment of the same pressure level by the fluid at the upstream and the downstream point of the inflow conduit. Thus the pressure-relief valve acts, according to my present invention, to immediately compensate any jumps in the pressure of the inflow conduit. A pressure gradient between the upstream and the downstream point of the inflow conduit causes the pressure-relief valve to open, thereby channeling overflow or overpressurization fluid from the upstream portion of the inflow conduit to the reservoir. The pressure-relief valve closes again only upon an equalization of pressure throughout the inflow conduit.

BRIEF DESCRIPTION OF THE DRAWING

These and other features of my present invention will now be described in detail, reference being made to the accompanying drawing in which:

FIG. 3 is a hydraulic-circuit diagram of a three-way flow-regulating valve according to my present invention, showing a throttle valve feeding an outflow conduit; and FIG. 4 is a graph showing the rate of flow into the outflow conduit of FIG. 3 as a function of the area of the opening in the throttle valve.

SPECIFIC DESCRIPTION

Figure 1:
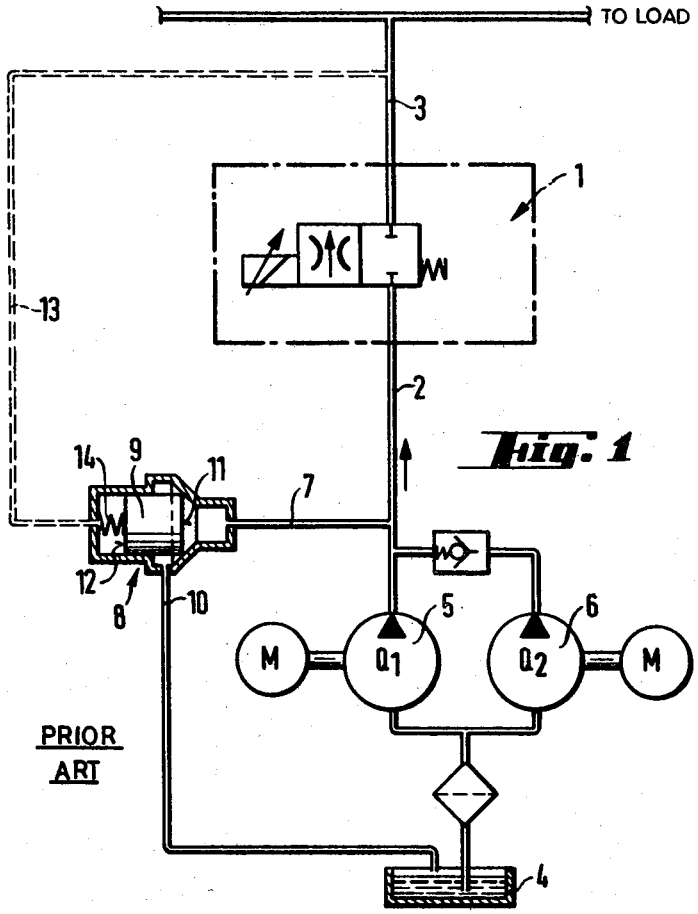
FIG. 1 is a hydraulic-circuit diagram of a conventional three-way flow-regulating valve, showing a component throttle valve inserted between an inflow conduit and an outflow conduit.

As illustrated in FIG. 1, a conventional three-way or three-ported flow-regulating valve comprises a throttle valve 1 inserted between an inflow conduit 2 and an outflow conduit 3. The throttle valve is implemented by a two-position two-port valve. The inflow conduit 2 is pressurizable by a pair of motor-driven pumps 5, 6 which draw pumping fluid from a storage reservoir 4. During a first phase of a fluid-transmission operation, pump 5 conveys fluid from reservoir 4 through conduit 2, valve 1 and conduit 3 to a nonrepresented load. During a second operating phase, pump 6 is actuated to assist pump 5 in the pressurization of inflow conduit 2 and thereby to augment the rate of flow through throttle valve 1 and outflow conduit 3.

Inflow conduit 2 is connected via a branch conduit 7 to one input of a pressure-relief valve 8 having another chamber communicating with outflow conduit 3 via a pressure-transmission path 13. Valve 8 includes a piston 9 biased by a spring 14 and having a first pressure surface 11 acted upon by pumping fluid carried from inflow conduit 2 via branch 7. A second pressure surface 12 of piston 9 engages one end of spring 14 and is acted upon by a fluidic pressure transmitted by path 13 from conduit 3. Surfaces 11 and 12 are equal in area.

The force exerted by biasing spring 14 on piston 9 determines an upper limit of the pressure drop across throttle valve 1. Upon an exceeding of this maximum by the pressure difference between inflow conduit 2 and outflow conduit 3, piston 9 shifts from a closed position, illustrated in FIG. 1, to an open position in which fluid is channeled from inflow conduit 2 through branch 7 and into a run-off conduit 10 extending from valve 8 to reservoir 4.

Figure 2:
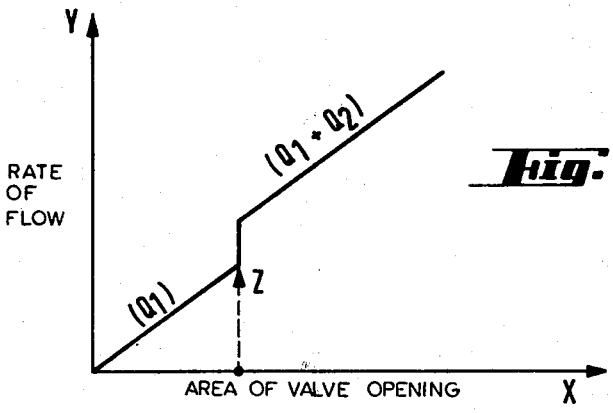
FIG. 2 is a graph showing the rate of fluid flow Y into the outflow conduit of FIG. 1 as a function of the area X of the opening in the throttle valve.

FIG. 2 is a graph showing the rate of fluid flow Y into conduit 3 from valve 1 as a function of the area of the valve opening X. Generally the rate of flow is a linear function of the valve opening. However, there is a discontinuity Z in the graph due to increased pressurization of inflow conduit 2 by auxiliary pump 6 at the onset of the second operating phase. The jump in the output rate of valve 1 at discontinuity Z has a destabilizing and a wearing effect on machinery driven by pumps 5 and 6.

As illustrated in FIG. 3, in a three-ported flow-regulating valve according to my present invention, pressure-relief valve 8 is not connected to outflow conduit 3. Instead a pressure-transmission channel 16 and a branch 13 thereof extend from inflow conduit 2 at an intake or input port 15 of throttle valve 1 to the chamber of the pressure-relief valve 8 containing biasing spring 14. Channel 16 has two further branches 19 and 20, branch 20 working into the input port of a two-position two-way servovalve 21. This valve includes a piston biased by a spring 24 and provided with a first surface 22 acted upon by fluidic pressure transmitted from inflow conduit 2 via channel 16 and branch 19. The piston of valve 21 has a second pressure surface 23 equal in area to surface 22 and acted upon by fluid carried from outflow conduit 3 via a pressure-transmission path or channel 18. Servovalve 21 has an output port communicating with path 18 via a low-pressure line 25. This line could alternatively extend to reservoir 4.

Transmission channels 16, 18 and branches 13, 19 and 20 have small cross-sectional areas compared to the areas of conduits 2 and 3. Branches 13, 19 and 20 are advantageously provided with diaphragms (orifice slates or restrictions) 26*a*, 26*b* and 26*c*, respectively.

In a flow-regulating valve according to my present invention the maximum pressure drop across throttle valve 1 is determined by the force exerted by spring 24. Spring 14 exerts a force on piston 9 sufficient to return the same to its closed position only upon an effective equalization of the pressure in inflow conduit 2 at a downstream point represented by the intersection of branch 7 with conduit 2 and an upstream point located at input port 15.

As indicated by the flow-rate-versus-valve-opening graph of FIG. 4, a three-way valve according to my present invention eliminates the flow-rate jump induced at the onset of the second operating phase by the activation of auxiliary pump 6. Upon an increase in the pressurization of conduit 2 at the junction of branch 7 and the inflow conduit, due to the activation of pump 6, valve 8 acts to relieve the difference in pressure between the upstream and downstream portions of the inflow conduit by channeling overflow fluid therefrom into run-off channel 10. In addition, a subsequent increase in the pressure at input port 15 causes servovalve 21 to open against the combined force exerted by biasing spring 24 and fluidic pressure from outflow conduit 3. Thus valve 21 serves to supplement the depressurization action of pressure-relief valve 8, thereby preventing a sudden increase in the rate of fluid flow through outflow conduit 3 due to the actuation of pump 6 at 2' in FIG. 4.

I claim:

1. In a system for delivering a fluid to a load and comprising a reservoir, at least two pumps for selectively delivering fluid to said load and connected to a pressure line running to said load, and a throttle valve having an inlet and an outlet and connected in said pressure line for controlling the flow of fluid through said throttle valve, the improvement which comprises a three-way flow-regulating valve assembly for preventing surges in the rate of flow of fluid to said valve resulting from combined delivery of fluid from said pumps, said flow-regulating valve assembly comprising:

a pressure-relief valve having a slidable valve body establishing communication between a first port connected to said pressure line and a second port connected to said reservoir, said body having a first effective cross section exposed to fluid pressure in a first chamber communicating with said first port and a second cross section effective in a direction opposite that of the first effective cross section and exposed to fluid pressure in a second chamber, and a spring isolated from system fluid pressure biasing said body into a position blocking communication between said first and second ports when the pressures in said chambers are equal; and a two-port two-position servovalve in a bypass loop around said throttle valve having a pair of ports respectively connected directly to said inlet and said outlet, a valve member shiftable between a first position blocking communication between the ports of said servovalve and a second position enabling throttle flow through said servovalve between the port connected to said outlet, said servovalve being provided with fluid pressure control means including a first conduit branch connected to said inlet and effective to urge said member into said second position and another conduit branch connected to said outlet and effective to urge said member into said first position, and a spring biasing said member into said first position, said second chamber being connected with said inlet for pressurization by fluid at the pressure thereof and upstream of the throttle formed by said member in said second position whereby, when the pressure differential across said throttle valve exceeds the biasing force of the servovalve spring, the servovalve moves to the second position thereof to thereby relieve the fluid pressure in said second chamber through said servovalve and allow fluid pressure at said first port to open said pressure-relief valve to admit fluid from said first chamber to said reservoir.

* * * * *